US008173914B2

(12) United States Patent
Poyner

(10) Patent No.: US 8,173,914 B2
(45) Date of Patent: May 8, 2012

(54) SAFETY SWITCH

(75) Inventor: Julian Poyner, Stockport Cheshire (GB)

(73) Assignee: Rockwell Automation Limited, Maldon, Essex (GB)

( * ) Notice: Subject to any disclaimer, the term of this patent is extended or adjusted under 35 U.S.C. 154(b) by 935 days.

(21) Appl. No.: 12/190,708

(22) Filed: Aug. 13, 2008

(65) Prior Publication Data

US 2009/0045037 A1 Feb. 19, 2009

(30) Foreign Application Priority Data

Aug. 16, 2007 (GB) ..... 0715957.7

(51) Int. Cl.
*H01H 27/00* (2006.01)

(52) U.S. Cl. ..... 200/43.04; 200/43.01; 200/43.07; 200/43.11

(58) Field of Classification Search ..... 200/43.04, 200/43.01, 43.05, 43.07, 43.11, 50.01
See application file for complete search history.

(56) References Cited

U.S. PATENT DOCUMENTS

| | | | | |
|---|---|---|---|---|
| 5,062,668 | A | 11/1991 | Onderka et al. | |
| 5,777,284 | A | 7/1998 | Mohtasham | |
| 6,872,898 | B2 | 3/2005 | Mohtasham | |
| 7,223,927 | B2 * | 5/2007 | Poyner | 200/43.04 |

FOREIGN PATENT DOCUMENTS

| | | | |
|---|---|---|---|
| EP | 1739699 | A1 | 3/2007 |

OTHER PUBLICATIONS

European Search Report (Application No./Patent No. 08252457.0 / 2026367).

* cited by examiner

*Primary Examiner* — Renee S Luebke
*Assistant Examiner* — Lheiren Mae Caroc
(74) *Attorney, Agent, or Firm* — Boyle Fredrickson, S.C.; William R. Walburn; John M. Miller

(57) ABSTRACT

A lockable safety switch mechanism having a lockable switch mechanism that cooperates in an offset or skewed manner with an electrical switch. The lockable switch mechanism includes a switch plunger that is displaceable along a predetermined axis between a first position and a second position. A contour is formed along the switch plunger and cooperates with one or more locking mechanisms. A fork cooperates with the locking mechanism so as to selectively interfere with free movement of the switch plunger depending on the interaction between the contour and the locking mechanism. A link extends from one of the locking mechanism and the fork and interacts with a plunger of an electrical switch contact carrier so that an axis of movement of the switch plunger can be offset or skewed relative to an axis of movement of the electrical switch plunger.

20 Claims, 15 Drawing Sheets

SAFETY SWITCH

CROSS-REFERENCE TO RELATED APPLICATIONS

This application claims priority to United Kingdom Patent Application No. 0715957.7 filed on Aug. 16, 2007 and the disclosure of which is incorporated herein.

BACKGROUND

The present invention relates to a safety switch, and in particular a safety switch having a lockable switch mechanism.

Safety switches are often used to control the supply of electricity to electrically powered machinery. Typically, a safety switch is located on a doorpost of an enclosure inside which is located kinetic machinery. On the door to the enclosure is located an actuator which is engageable with the safety switch. When the door to the enclosure is opened, the actuator is not in engagement with the safety switch. When the actuator is not engaged with the safety switch, electrical contacts within the safety switch are kept apart such that electricity may not be supplied to the machinery within the enclosure. Thus, a user may enter and move around the enclosure with a reduced risk of injury, since the machinery is not operating. If the door to the enclosure is closed, the actuator is brought into engagement with the safety switch. The contacts in the safety switch are then brought into contact with each other such that electricity may be supplied to the machinery within the enclosure. This sort of arrangement, which is often referred to as a safety interlock, is used in a wide variety of applications.

A safety switch having a lockable switch mechanism is described in U.S. Pat. No. 6,872,898. That safety switch comprises a mechanism which comprises a plurality of elements that co-operate to lock a switch plunger in position, or allow it to move. Part of the locking mechanism comprises a solenoid and a solenoid plunger. The solenoid plunger is moveable in the solenoid and abuts against a contact block plunger of a contact block. When the solenoid plunger is energised, the solenoid plunger moves, which in turn causes or allows movement of the contact block plunger. The contact block plunger is moveable to move bridging contacts into or out of electrical connection with fixed contacts of the contact block to allow or prevent a safety switch of which the switch mechanism is a part to allow or prevent the conduction of electricity (e.g. to machinery in a machine guard).

The locking arrangement disclosed in U.S. Pat. No. 6,872,898 works well. However, existing safety switches which use this arrangement have a number of disadvantages. The way in which elements of the safety switch are positioned restricts the overall shape of the safety switch. Furthermore, due to the large number of co-operating elements of the safety switch, the design and manufacturing tolerances that need to be met to produce a reliable safety switch are very small.

It is therefore an object of the present invention to obviate or mitigate at least one of the disadvantages of the prior art, whether identified herein or elsewhere.

SUMMARY OF THE INVENTION

According to the present invention, there is provided a safety switch mechanism that includes a lockable switch mechanism comprising a switch plunger which is mounted in a housing and is displaceable relative to the housing along a predetermined axis between a first unlocked position and a second position. The switch mechanism includes a locking mechanism for locking the switch plunger in the second position and a switch mechanism which is actuated by movements of the switch plunger between the first and second positions. The locking mechanism comprises at least one first locking member which is biased against a surface of the switch plunger and at least one second locking member which is displaceable between locked and released positions. The surface of the switch plunger against which the first locking member is biased defines a profile that is arranged such that movement of the switch plunger from the second to the first position causes the profile to displace the first locking member and the second locking member when in the locked position preventing displacement of the first locking member by the profile to thereby prevent movement of the plunger from the second to the first position. The switch mechanism includes a contact block having a set of fixed contacts and a contact block plunger. The contact block plunger includes at least one bridging contact and is moveable in the contact block to move the bridging contact into and out of electrical connection with the set of fixed contacts. The second locking member is attached to the contact block plunger via a linking member.

At least in part by attaching the second locking member to the contact block plunger, the safety switch mechanism of the present invention may be easier to reliably construct than similar prior art mechanisms. It is further appreciated that the overall shape not be restricted to being elongate, as described in more detail below.

Preferably, the contact block is provided with a biasing means which biases the contact block plunger such that the bridging contact is biased away from the fixed contacts. Preferably, the biasing means is only able to push apart the bridging contact and the fixed contacts when the linking member breaks, deforms, or becomes detached from one or both of the second locking member and the contact block plunger.

Preferably, each first locking member comprises a locking pin extending transversely relative to the axis of displacement of the switch plunger. The locking pin is spring biased towards the switch plunger in a direction perpendicular to the switch plunger axis. Two locking pins may be provided on opposite sides of the switch plunger. The locking pins may be mounted in a housing assembly that defines an aperture through which the switch plunger extends. The locking pins are preferably spring-biased towards each other from opposite sides of the aperture by springs supported in the housing assembly. The housing assembly may comprise a frame which receives the locking pins and springs and a cover plate that retains the locking pins and springs within the assembly.

The profile may be defined by an annular shoulder extending around the switch plunger. The shoulder may be tapered so as to readily lift the locking pins away from the switch plunger if the mechanism is not in the locked condition. One or more of the locking members may comprise a locking arm which is displaceable in a direction parallel to the switch plunger axis and, when in the locked position, extends on the side of the first locking member remote from the switch plunger to prevent displacement of the first locking member in a direction away from the switch plunger axis. Two locking arms may be provided to lock respective locking pins against displacement relative to the switch plunger axis. The locking arms may extend from one end of a solenoid plunger which is arranged at one end of the switch plunger and is displaceable along the switch plunger axis by a solenoid winding within a solenoid housing. The solenoid may be arranged so that, when energised, the locking arms are displaced from the locked position, or alternatively may be arranged so that, when energised, the locking arms are displaced to the locked position.

A compression spring may be arranged between the switch and solenoid plungers to bias the plungers apart, and a compression spring may also be arranged between the solenoid plunger and the solenoid housing to bias the solenoid plunger towards the switch plunger. The switch plunger may be axially displaced by rotation of a cam from a datum position by insertion of an actuator into the mechanism. Withdrawal of the actuator is prevented unless the cam is rotated back to the datum position, and such rotation is prevented by the locking mechanism if each of the one or more second locking members is in the locked position.

The contact block maybe positioned alongside the lockable switch mechanism.

Movement of the contact block plunger may be arranged to be parallel to movement of the switch plunger.

The contact block plunger or contact block may be provided with guides or channels for guiding movement of the contact block plunger.

BRIEF DESCRIPTION OF THE DRAWINGS

Embodiments of the present invention will now be described, by way of example only, with reference to the accompanying drawings, in which.

DETAILED DESCRIPTION

Figure 1:
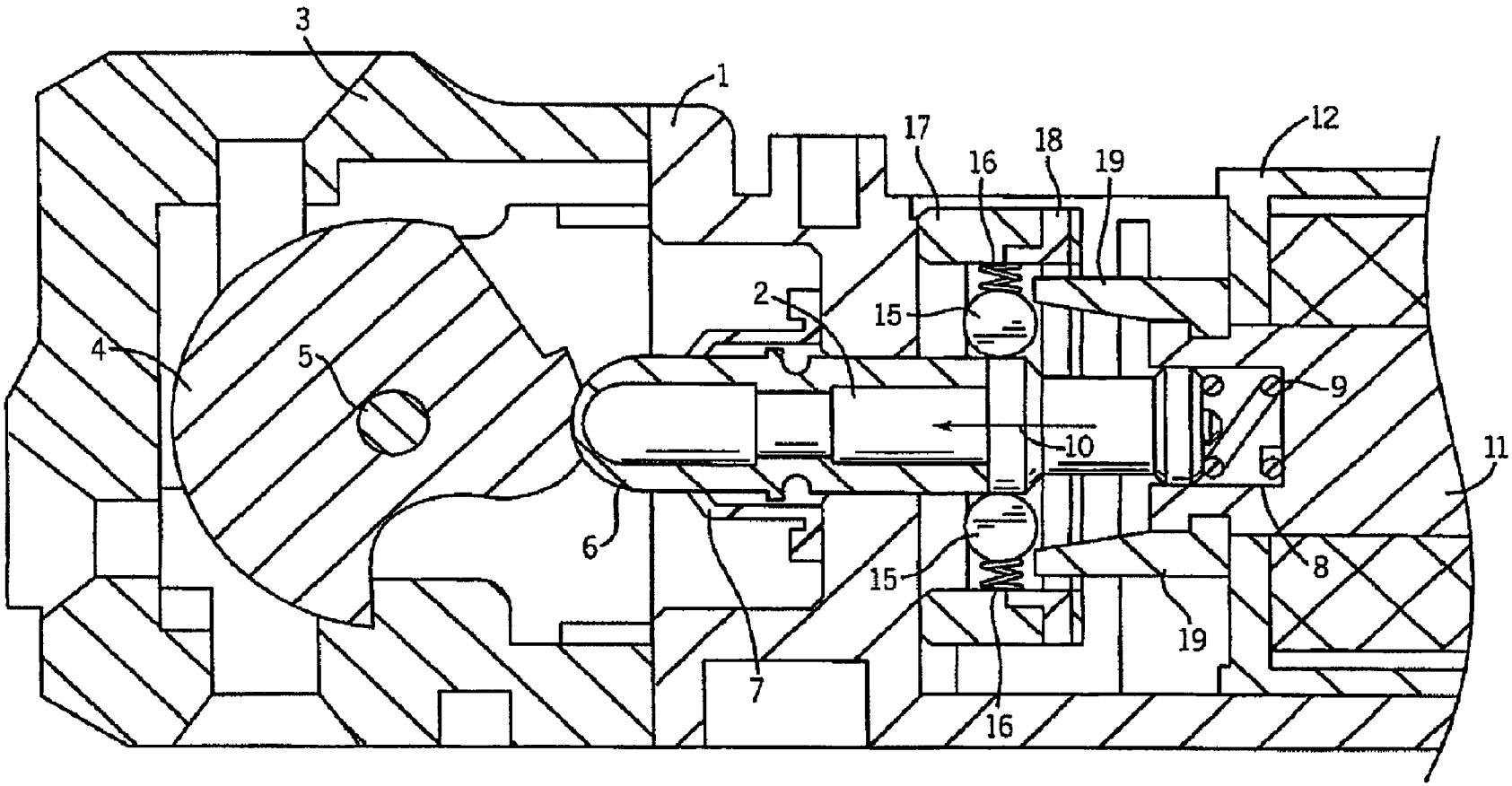
FIG. 1 is a schematic cut-away view of a locking switch mechanism of a safety switch in accordance with an embodiment of the present invention with the switch in an unlocked condition.

Referring to FIG. 1, the illustrated lockable switch mechanism comprises a housing 1 in which a plunger 2 is slidable and which supports a head assembly 3 supporting a rotatable cam 4, the cam 4 being rotatable about a pin 5. The plunger 2 comprises a metal core supporting an outer casing 6 which is slidably received in a sealing cap 7. The plunger 2 is symmetrical about its longitudinal axis and is slidable relative to the housing 1 along that axis.

The end of the plunger 2 remote from the cam 4 is received in a bore 8. A compression spring 9 is located within the bore 8 and biases the plunger 2 in the direction indicated by arrow 10. The bore 8 is formed in the end of a solenoid plunger 11 which is received within a solenoid housing 12. Energisation of a solenoid winding (not shown) in the solenoid housing 12 drives the solenoid plunger 11 to the right in FIG. 1. Denergisation of the solenoid results in the solenoid plunger 11 being moved to the left with respect to the orientation shown FIG. 1 by a compression spring 13 (FIG. 2) which is located between the solenoid housing 12 and a locking fork 14 which is engaged in a groove extending around the end of the solenoid plunger 11 in which the bore 8 is formed.

Two locking pins 15 are positioned on either side of the plunger 2. The locking pins 15 are biased by springs 16 against the plunger 2. The locking pins 15 and springs 16 are retained within a housing assembly made up from a frame 17 and a cover plate 18. It will be seen that with the plunger 2 in the position shown in FIG. 1, the pins 15 are held at a distance from the axis of the plunger 2 such that they obstruct the passage of arms 19 supported by the locking fork 14 in the direction of the arrow 10.

Figure 2:
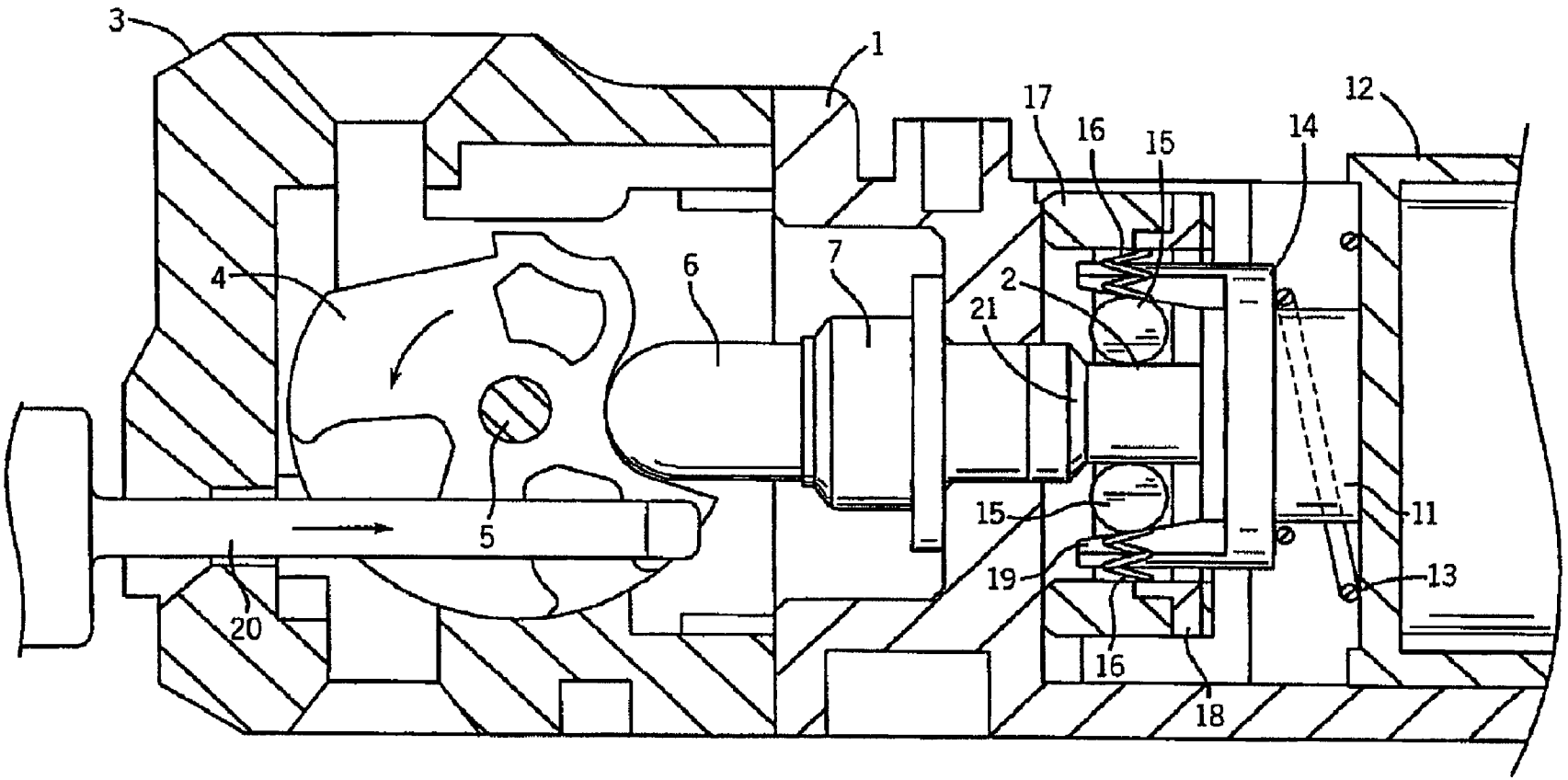
FIG. 2 illustrates the mechanism of FIG. 1 after the insertion of an actuator to switch the mechanism and locking of the mechanism.

FIG. 2 shows the assembly of FIG. 1 after the insertion of an actuator 20 into the head assembly 3 so as to cause rotation of the cam 4. Such rotation of the cam 4 enables the plunger 2 to move towards the pin 5. As a result a profile 21 in the form of an annular shoulder on the plunger 2 is moved to the left of the locking pins 15. The locking pins 15 are biased towards each other so as to remain in contact with the plunger 2, thereby enabling the arms 19 of the locking fork 14 to pass the locking pins 15.

The actuator 20 and cam 4 are shaped such that insertion of the actuator into the head assembly 3 causes the cam to rotate from a datum position or the position of the cam 4 as shown in FIG. 1. The actuator defines projections (not shown) which engage in recesses defined by the cam 4 (as shown in FIG. 2) so that once the cam 4 has been rotated from the datum position, the actuator 20 cannot be withdrawn from the head assembly 3 unless the cam 4 has been rotated back to the datum position. An actuator and cam mechanism of this general type is described in U.S. Pat. No. 5,777,284.

Figure 3:
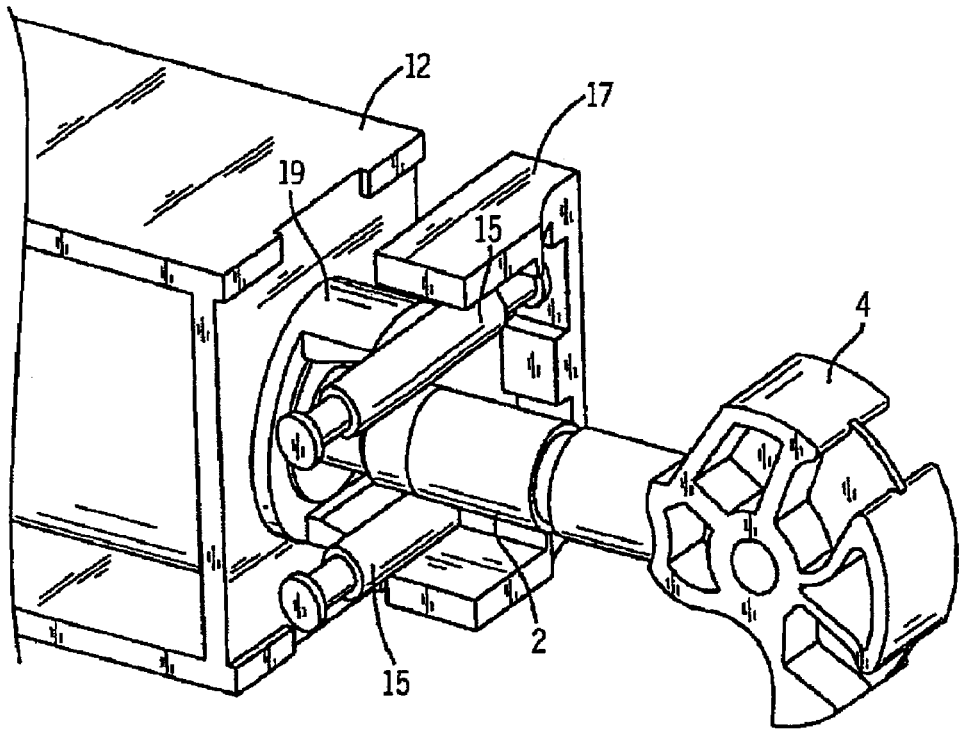
FIG. 3 is a partial perspective view of some of the components of the mechanism of FIGS. 1 and 2 showing those components in the positions adopted when the switch is unlocked as shown in FIG. 1.
Figure 4:
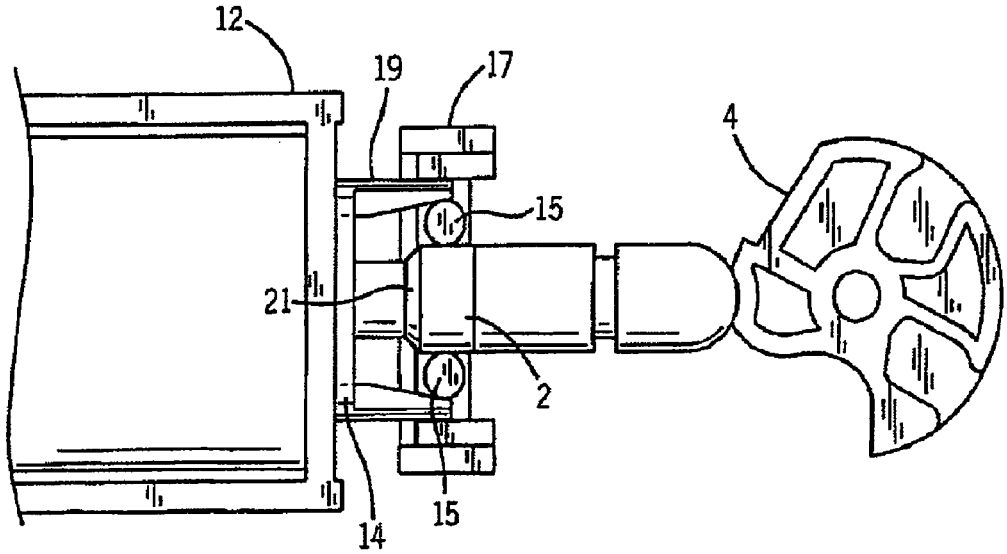
FIG. 4 is a side view of the components of FIG. 3.
Figure 5:
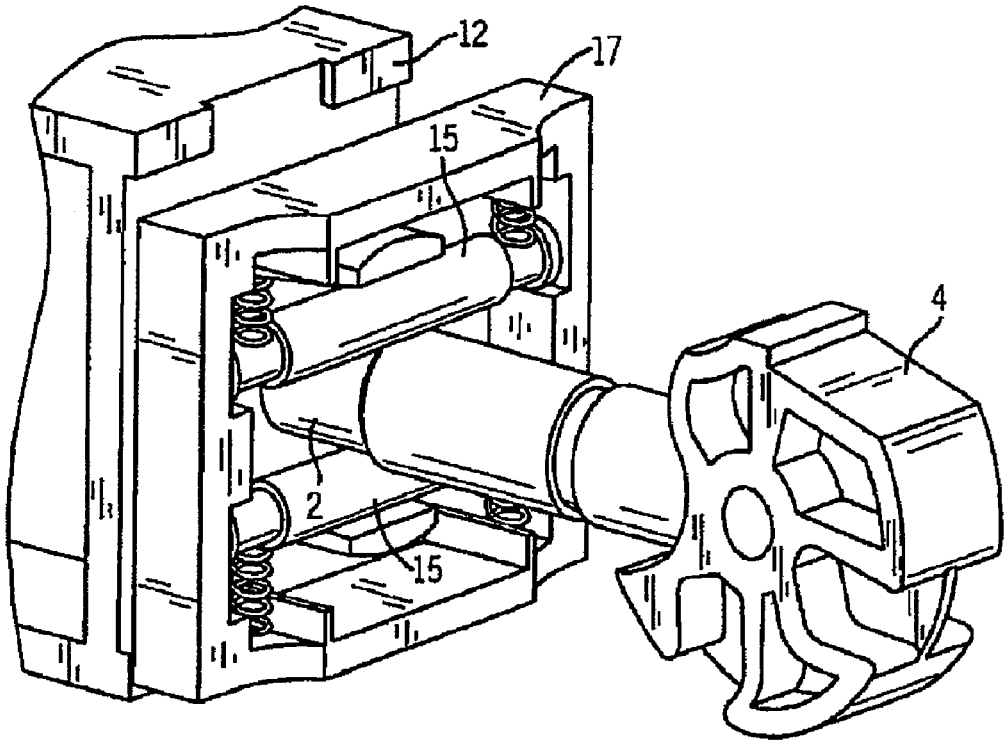
FIG. 5 is a partial perspective view of the components shown in FIGS. 3 and 4 with those components in the switch locked position corresponding to FIG. 2.
Figure 6:
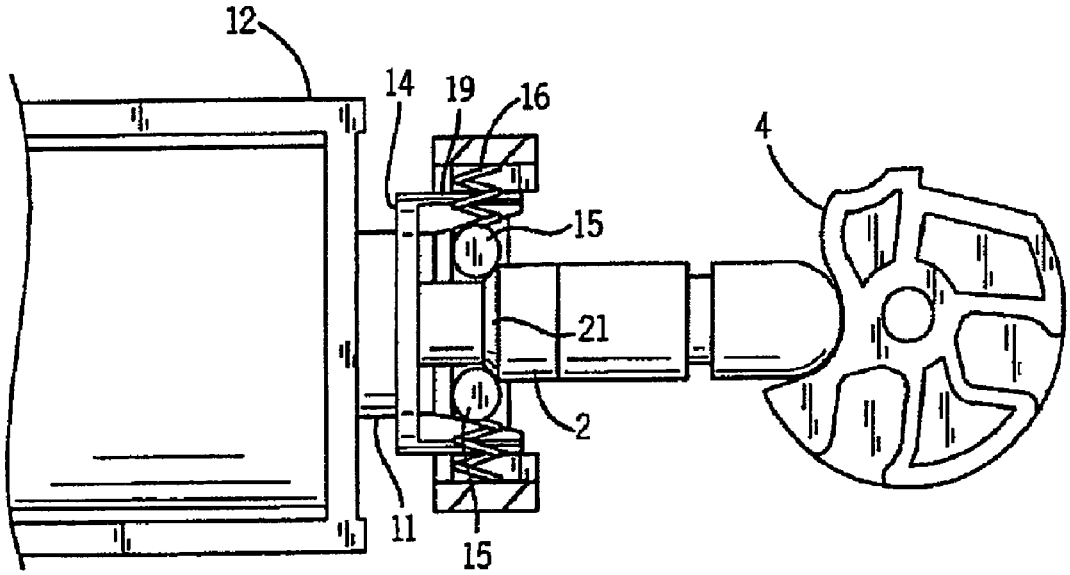
FIG. 6 is a side view of the components shown in FIG. 5.

FIGS. 3 and 4 show a perspective view of a portion of the assembly in the unlocked condition. In FIG. 3, the solenoid plunger 11 has been moved to the position it assumes when the solenoid is energised and the plunger 2 is in the position in which it is displaced by the cam 4 as far as possible towards the solenoid housing 12. As a result the spacing between the pins 15 is such that even if the solenoid is then deenergised the arms 19 cannot move past the pins 15. The pins 15 therefore impose no restraint on the axial displacement of the plunger 2. In contrast, as shown in FIGS. 5 and 6, if the cam 4 is then rotated to displace the plunger 2 so that the pins 15 can drop down the profiled shoulder 21 defined by the plunger 2, the springs 16 urge the locking pins 15 towards each other so as to engage behind the shoulder 21. Deenergisation of the solenoid then results in the arms 19 being extended past the pins 15, restraining the pins 15 against movement away from each other. Any attempt therefore to drive the plunger 2 towards the solenoid housing 12 will be resisted as a result of the pins 15 jamming between the profile 21 and the arms 19.

Figure 7:
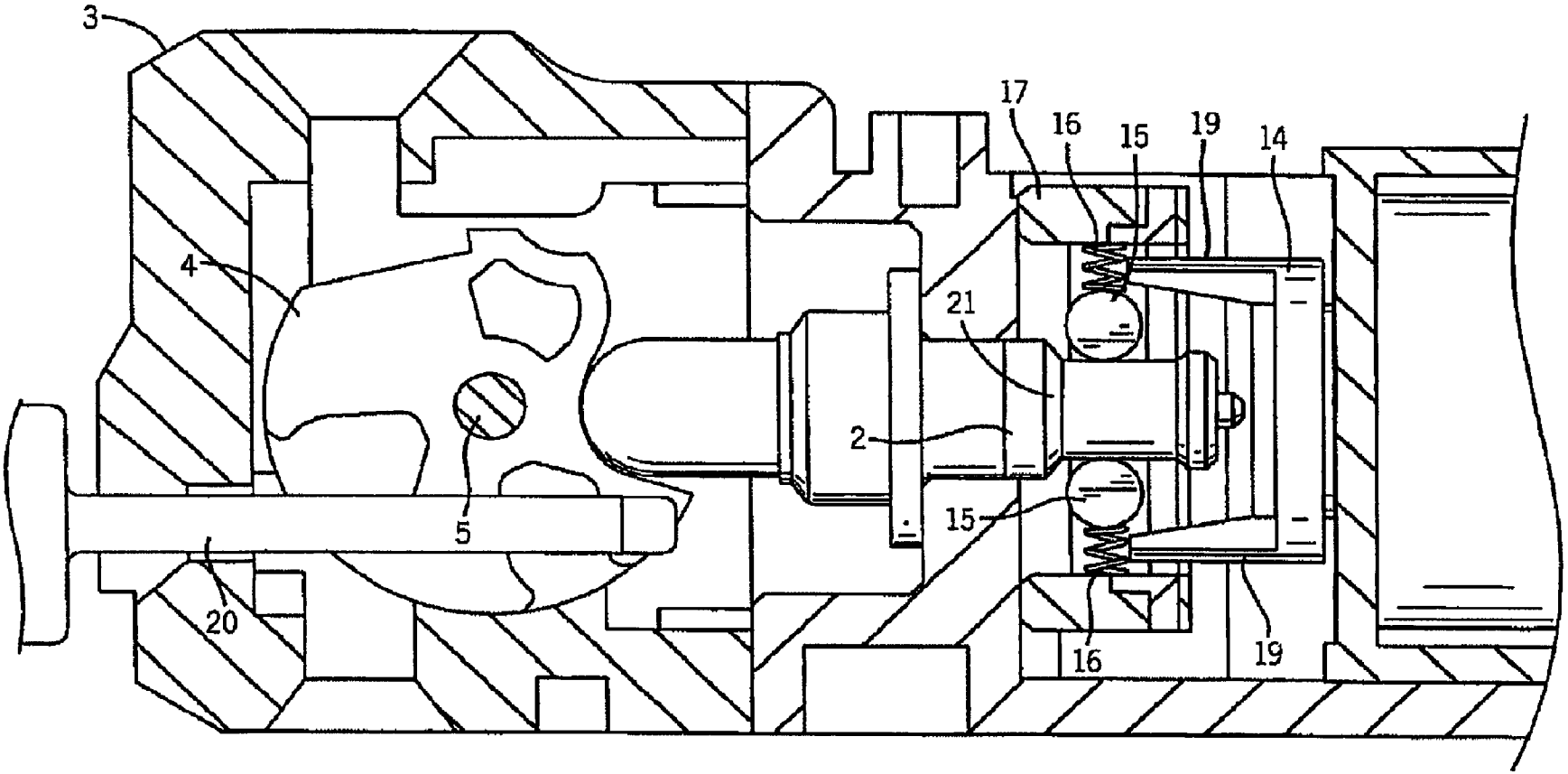
FIG. 7 shows the mechanism of FIGS. 1 to 6 after insertion of an actuator but before locking of the mechanism.

FIG. 7 shows the assembly after displacement of the plunger 2 towards the cam pin 5. Unless the solenoid is energised, the arms 19 of the locking fork 14 will engage around the pins 15 as shown in FIGS. 5 and 6. In the configuration shown in FIG. 7 however the solenoid has been energised, displacing the arms 19 to the right. There is then nothing to stop the locking pins 15 being moved apart against the biasing force provided by the springs 16. Thus if the actuator 20 was to be withdrawn from the head assembly 3 this would result in the displacement of the plunger 2 to the right in FIG. 7, such movement being permitted as the tapered surface of the shoulder 21 would push against and force apart the two locking pins 15.

Figure 8:
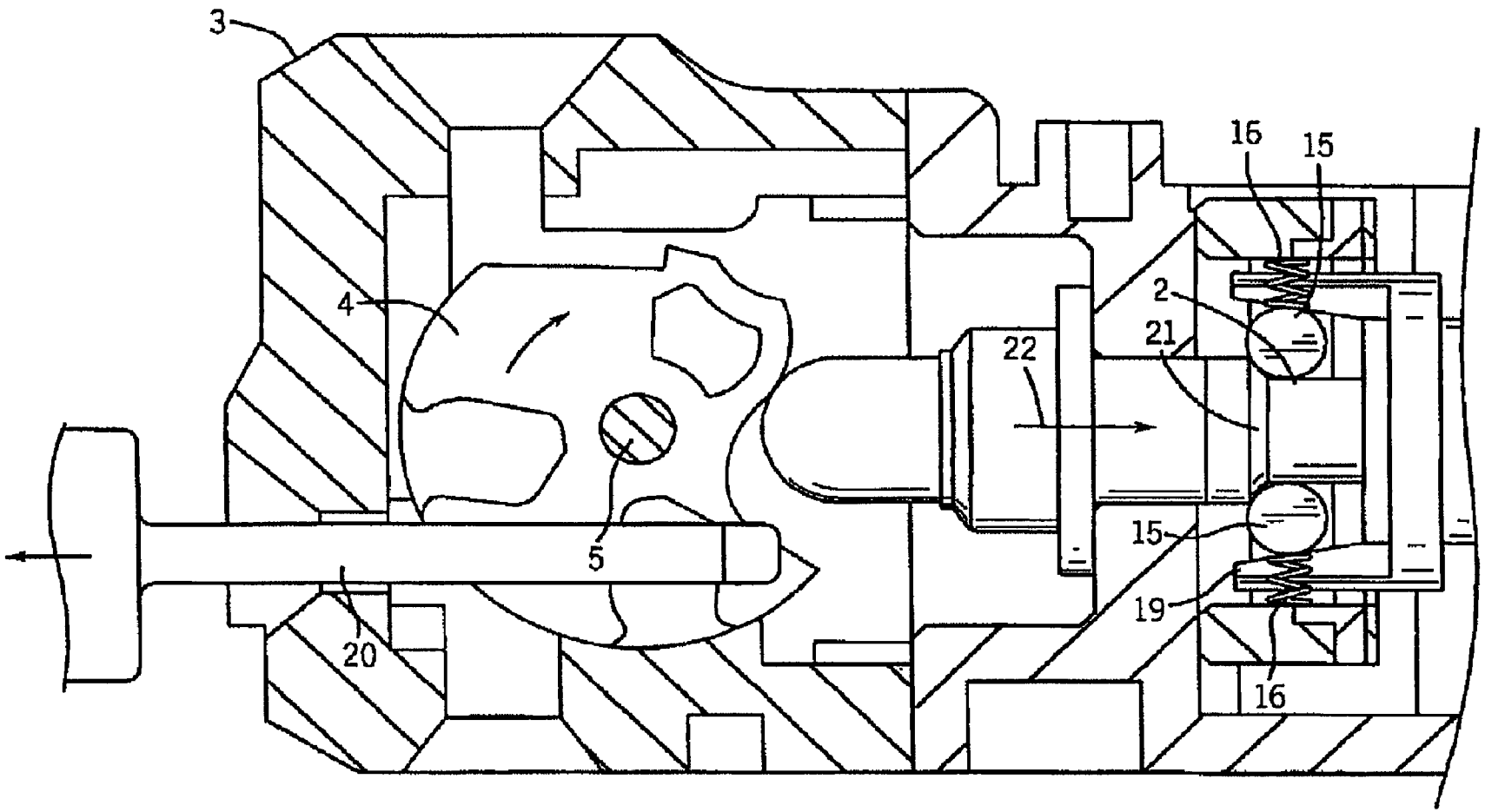
FIG. 8 illustrates the application of a force to withdraw the actuator when the mechanism is locked.

Referring to FIG. 8, this shows the assembly if an attempt is made to withdraw the actuator 21 when the assembly is in the configuration shown in FIG. 2, or with the pins 15 locked in position by the arms 19. Pulling on the actuator 20 causes the cam 4 to rotate in the clockwise direction in FIG. 8 thereby applying an axial force to the plunger 2 and causing the plunger to attempt to move in the direction indicated by arrow 22. Such displacement is however resisted by the locking pins 15 which bear against the profile 21. The arms 19 prevent the pins 15 moving apart and thus prevent further axial displacement of the plunger 2.

Figure 9:
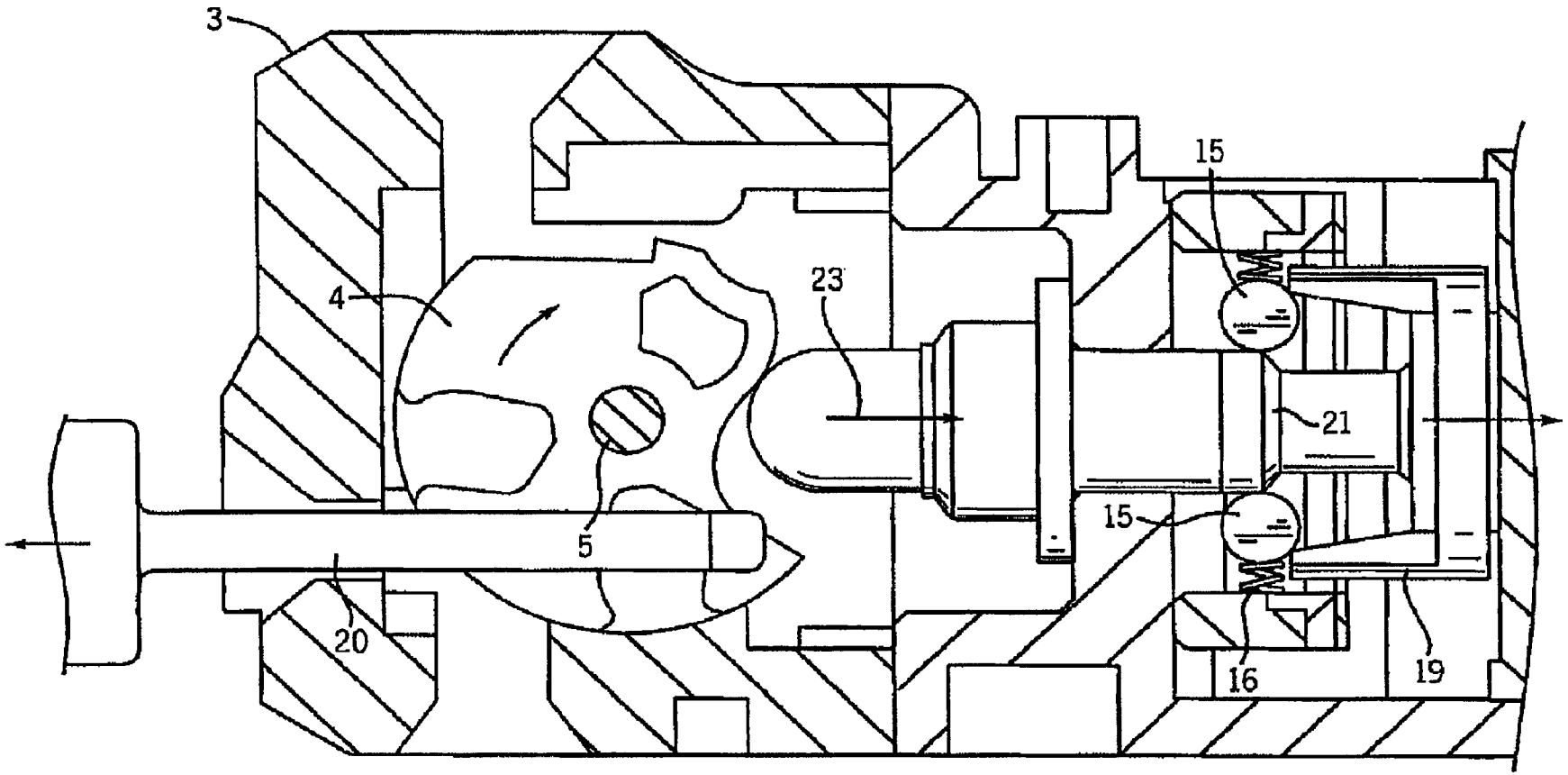
FIG. 9 illustrates the mechanism after unlocking of the mechanism and partial withdrawal of the actuator.

In contrast, if the solenoid is energised so as to displace the arms 19 to the position shown in FIG. 7, and the actuator 20 is pulled out of the head assembly 3, rotation of the cam 4 is not resisted by contact between the pins 15 and the profile 21 and as a result the plunger 2 can be displaced in the direction of arrow 23 as shown in FIG. 9.

Figure 10:
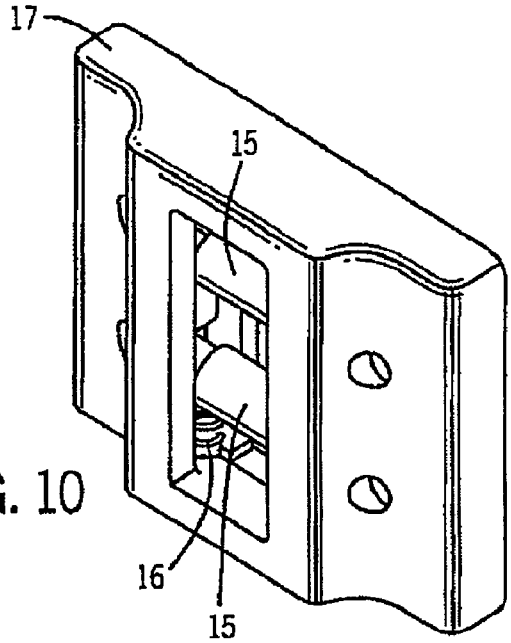
FIG. 10 is a perspective view of assembled components of the locking mechanism.
Figure 11:
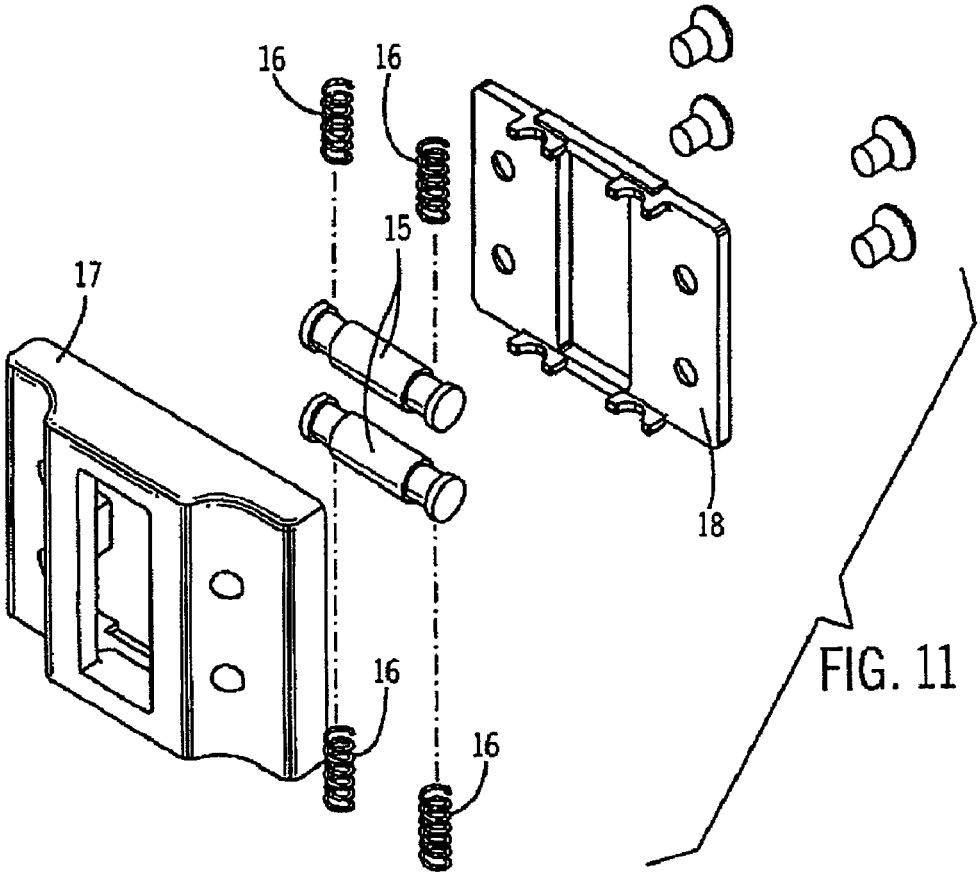
FIG. 11 is an exploded view of the assembly of FIG. 10.

FIG. 10 illustrates the housing assembly for the locking pins 15 and springs 16 and FIG. 11 shows the components of the assembly of FIG. 10 in exploded form. Pins 15 flank an opening generally associated with plunger 2. Frame 17 and cover plate 18 cooperate so as to support one or more pins 15 and springs 16 therebetween.

Figure 12:
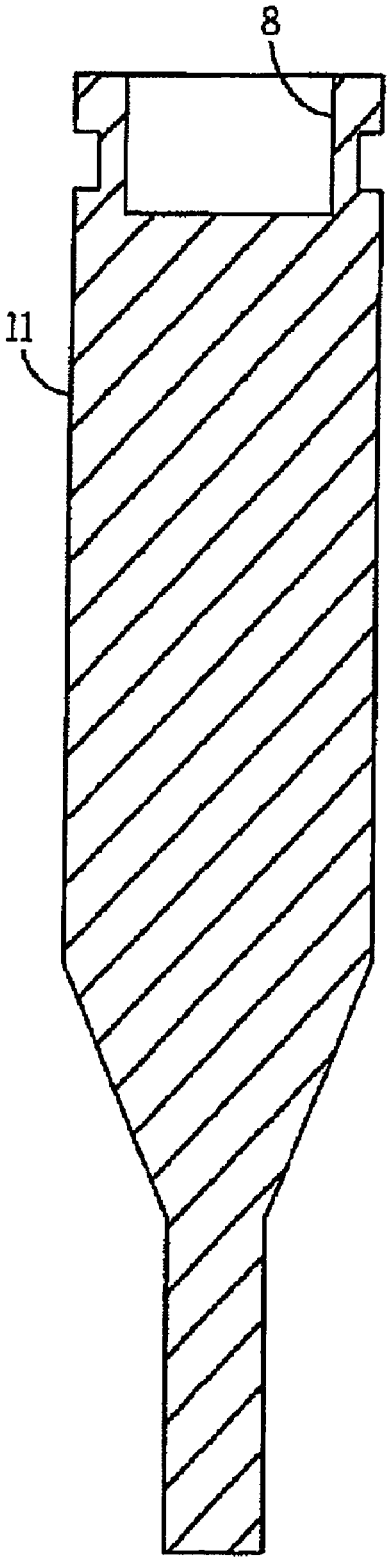
FIG. 12 is a sectional view through a solenoid plunger of the mechanism of FIGS. 1 to 11.
Figure 13:
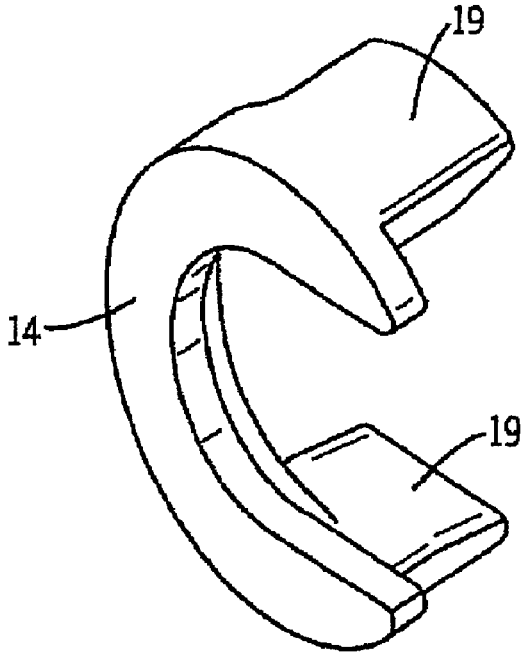
FIG. 13 is a perspective view of a solenoid locking fork of the mechanism of FIGS. 1 to 12.
Figure 14:
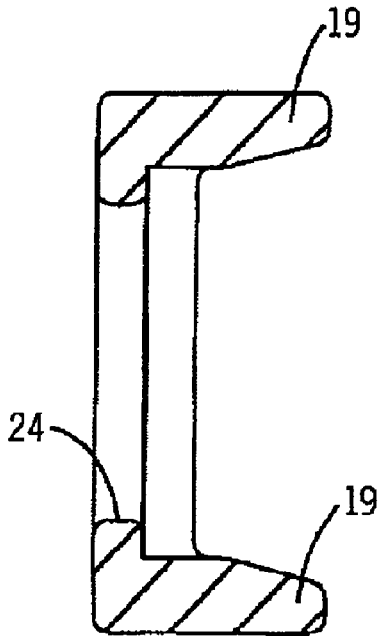
FIG. 14 is a sectional view through the solenoid locking fork of FIG. 13.

FIG. 12 is a sectional view through the solenoid plunger 11 showing the bore 8 and the groove extending around the end of the plunger 11 in which the bore 8 is provided, that groove being engaged by the locking fork 14 shown in FIGS. 13 and 14.

Referring to FIGS. 13 and 14, the locking fork 14 which supports the locking arms 19 has a C-shaped body defining an inwardly projecting edge 24, that edge being received in the groove or slot formed around the end of the solenoid plunger 11 shown in FIG. 12. The inner faces of the fork arms 19 are tapered such that, on energisation of the solenoid, the arms 19 are released easily from engagement with the pins 15.

Given the structure of the plunger and locking fork combination, it is a relatively easy matter to assemble the combination. In an alternative arrangement it would of course be possible to fabricate the plunger 11 and the locking fork 14 including the locking fork arms 19 as a single piece component.

Figure 15:
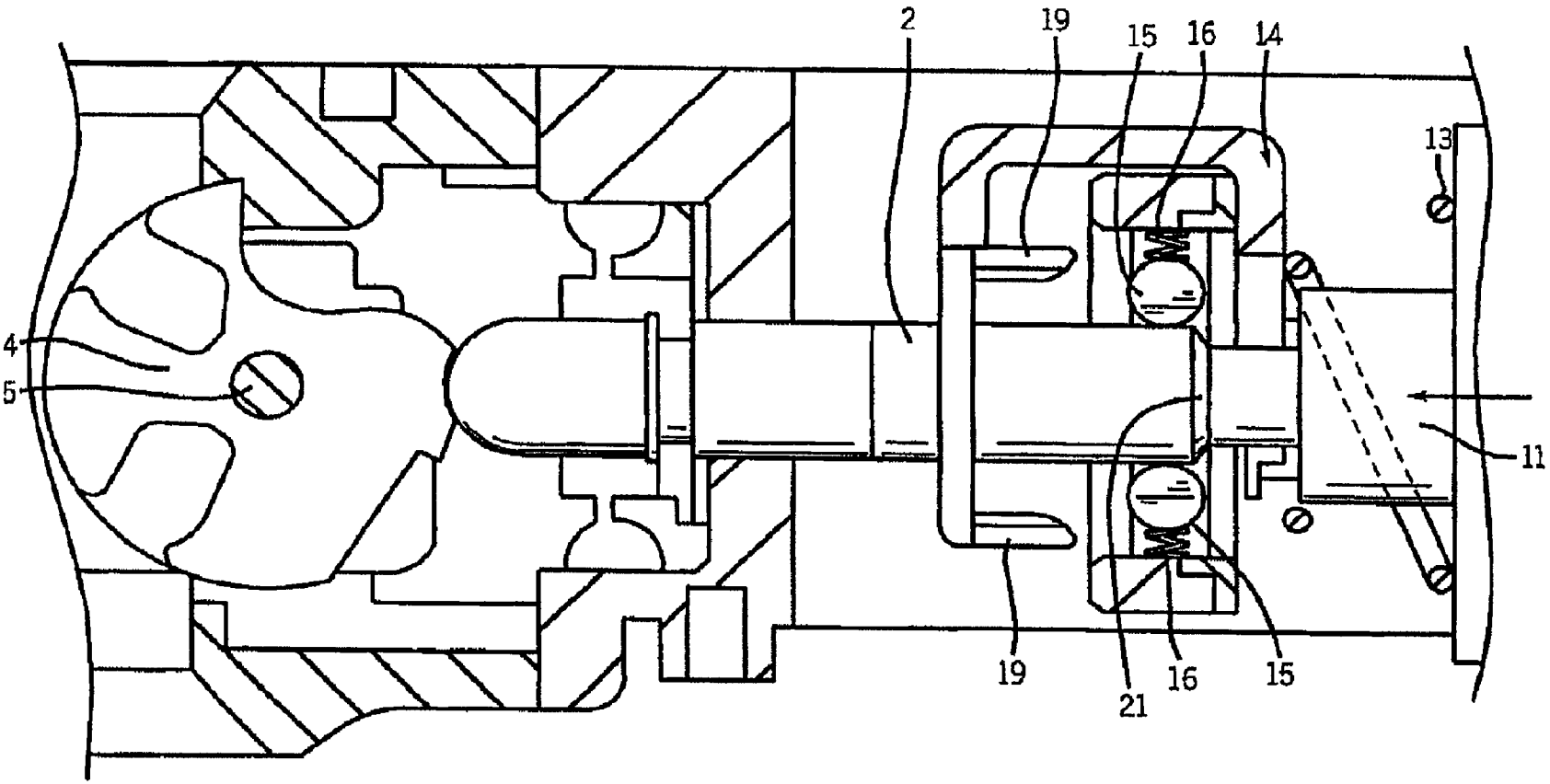
FIG. 15 is a schematic cut-away view of a locking switch mechanism in accordance with another embodiment of the present invention with the switch in an unlocked condition.
Figure 16:
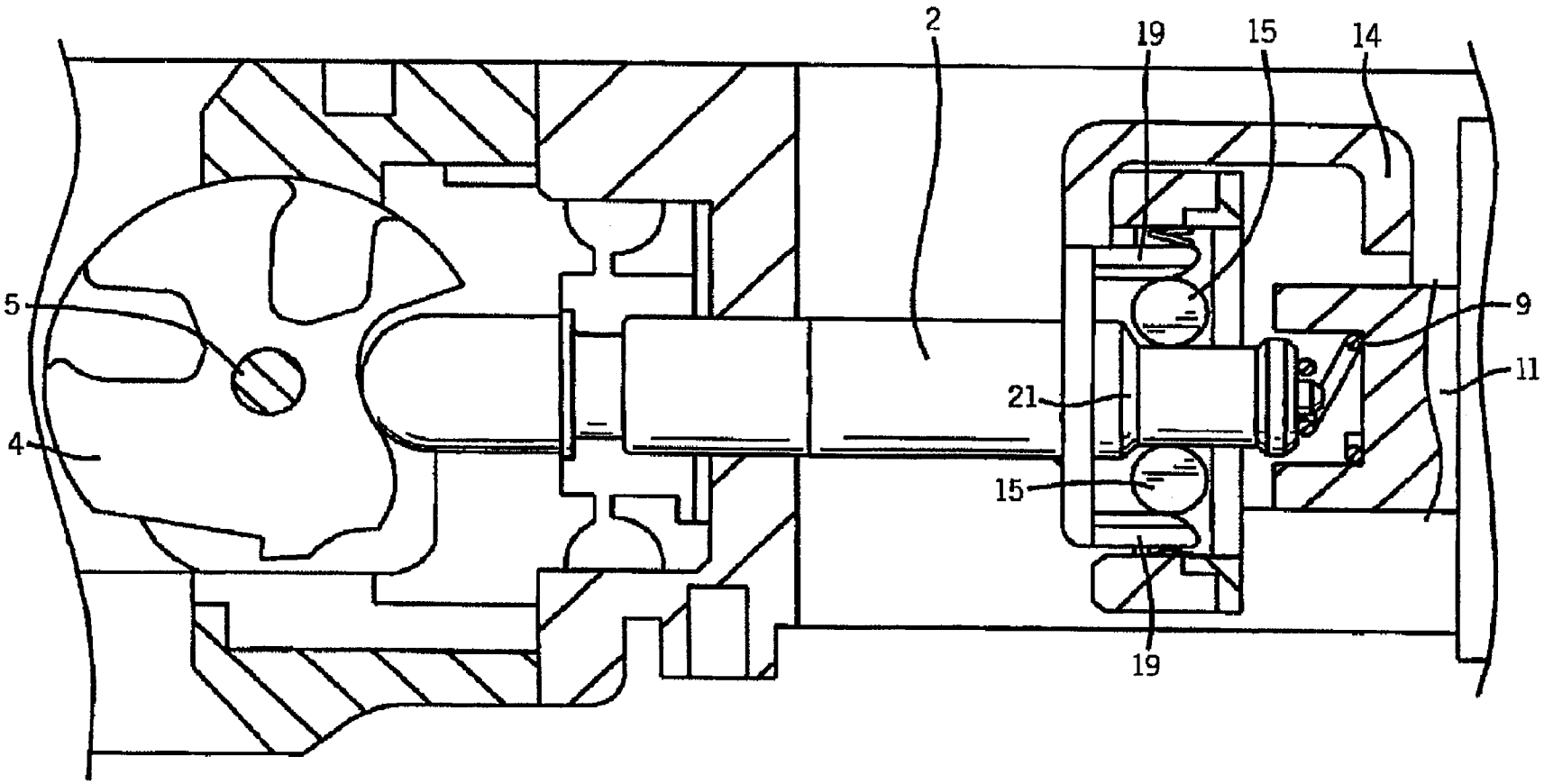
FIG. 16 illustrates the mechanism of FIG. 15 after the insertion of an actuator and locking of the mechanism.
Figure 17:
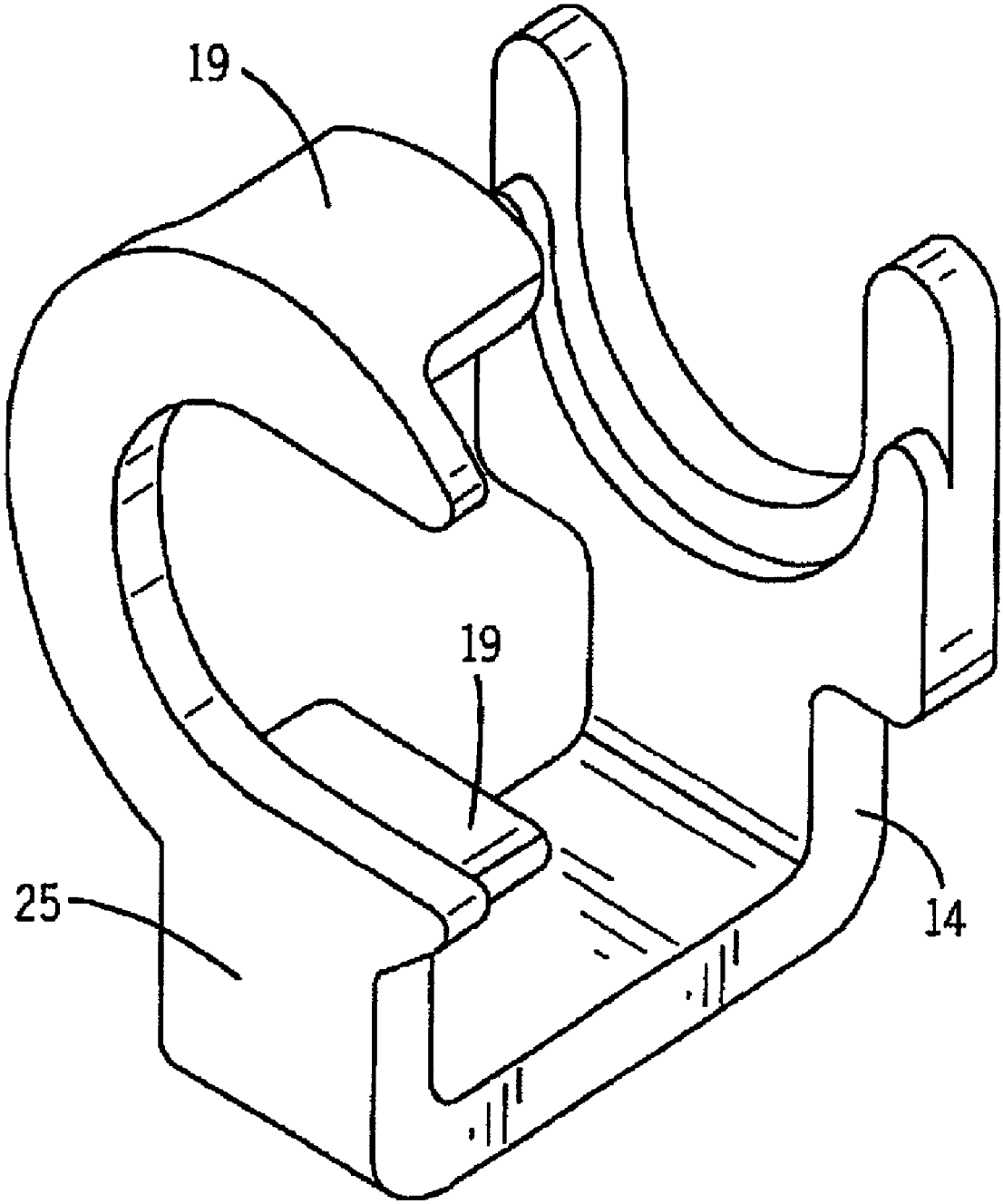
FIG. 17 is a perspective view of a locking fork of the mechanism of FIGS. 15 and 16.

In the embodiment of FIGS. 1 to 14, energisation of the solenoid is necessary to release the locking mechanism. Preferably, the solenoid is not energised accept when it is desired to release the locking mechanism. In the event of a power failure when the mechanism is locked, it is not possible to unlock the mechanism and therefore it is not possible to release the actuator from the cam. The actuator can only be released after the supply of power is restored. In some applications, this can be a significant disadvantage. FIGS. 15 to 17 illustrate a second embodiment, in which this disadvantage is avoided by relying upon a solenoid which is energised when the switch is locked and de-energised when the switch locking mechanism is released.

Referring to FIGS. 15 to 17, components of the second embodiment which are equivalent to components of the first embodiment shown in FIGS. 1 to 14 are identified by the same reference numerals. Thus, in the second embodiment a plunger 2 is biased against a cam 4 by a compression spring 9. The plunger 2 is located between a pair of locking pins 15 which are biased against the sides of the plunger 2 by springs 16. The plunger 2 defines a shoulder 21 behind which the locking pins 15 engage when the plunger 2 is displaced towards a pin 5 about which the cam rotates. FIG. 15 shows the locking mechanism before insertion of an actuator into the assembly so as to rotate the cam. In this configuration the locking pins 15 cannot engage behind the shoulder 21. FIG. 16 shows the mechanism after displacement of the plunger 2 as a result of rotation of the cam 4. In this configuration the pins 15 are biased inwards by the springs 16 so as to engage behind the shoulder 21. FIG. 16 shows the locking pins 15 after displacement of a locking fork 14 so that locking arms 19 extend outside the locking pins 15, thereby preventing the locking pins 15 from moving outwards. In the condition shown in FIG. 16, the plunger 2 cannot therefore be moved to the right in FIG. 16 as such movement would be prevented by inter-engagement between the shoulder 21 and the locking pins 15.

The locking fork 14 is mounted on solenoid plunger 11 and is biased towards the cam 4 by a compression spring 13. If the solenoid is de-energised, the spring 13 ensures that the locking arms 19 are displaced away from the locking pins 15. The mechanism is therefore unlocked in that axial movement of the plunger 2 is not obstructed. If the solenoid is energised, the plunger 11 is driven to the right with respect to the orientation shown in FIG. 16 such that, providing the plunger 2 is in the position shown in FIG. 16, the locking arms 19 can engage outside the locking pins 15, thereby locking the mechanism.

With the arrangement illustrated in FIGS. 15 and 16, the switch will remain locked only so long as the solenoid is energised. When it is desired to unlock the mechanism, the solenoid is simply de-energised. With such an arrangement it will be appreciated that, in the event of a power failure, the mechanism is automatically unlocked. In some applications this is a significant advantage. In contrast, with the mechanism illustrated in FIGS. 1 to 14, unlocking of the mechanism requires energisation of the solenoid and therefore in the event of a power failure it would not be possible to release the actuator 20 from the cam 4.

FIG. 17 illustrates the structure of the locking fork 14 of the embodiment of FIGS. 15 and 16 in greater detail. It will be noted that the locking arms 19 are mounted on an L-shaped extension 25 of the locking fork 14, the locking fork 14 defining a C-shaped body defining an inwardly projecting edge that is received in a slot formed around the end of the solenoid plunger 11.

In FIGS. 1 to 17, various embodiments of the locking mechanism of the safety switch have been described. The locking function is also supplemented by an electrical power supply interlock. That is, when the switch plunger is locked in position by the locking mechanism, the ability of the safety switch to allow or prevent the conduction of electricity is determined by the electrical power supply interlock. For example, when the plunger is locked in position to prevent removal of the actuator from the switch (and therefore, for example, the opening of the door or an enclosure) the safety switch may be moved to a conducting state, such that power may be supplied to machinery located in a machine guard. Conversely, when the plunger is not locked in position the actuator may be removed from the switch, causing the safety switch to move to a non-conducting state, such that power may be not supplied to machinery located in a machine guard.

Figure 18:
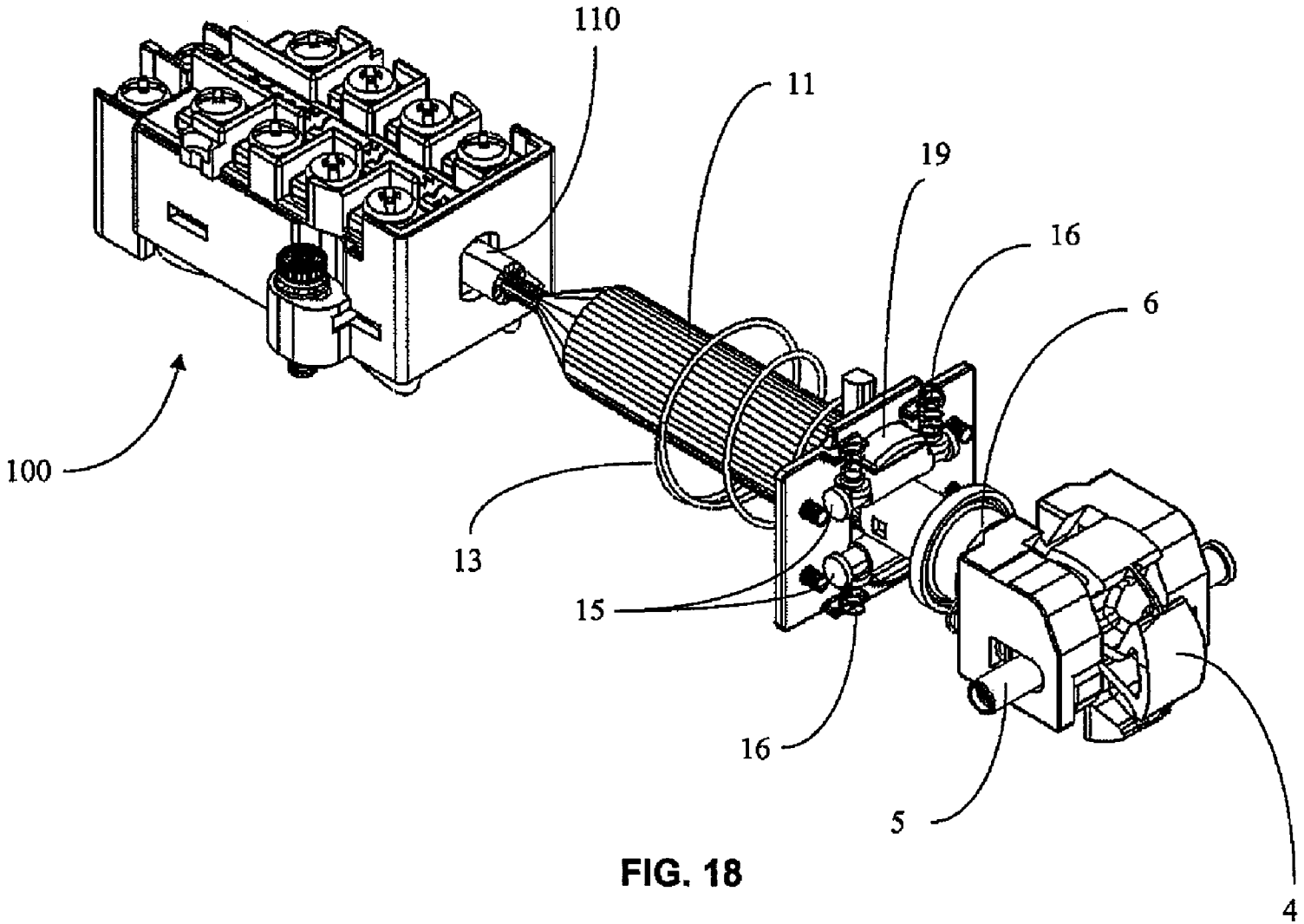
FIG. 18 is a simplified perspective view of an exemplary safety switch equipped with a locking switch mechanism.
Figure 19:
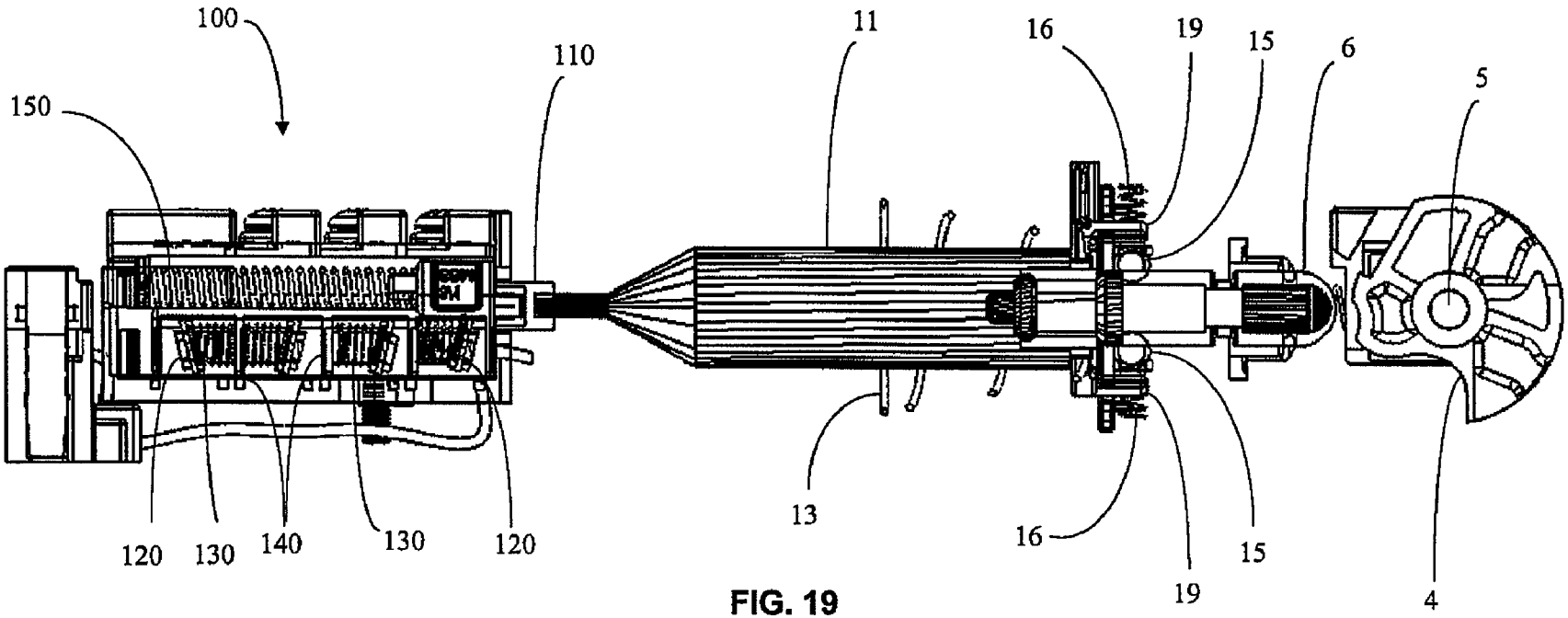
FIG. 19 is a cross-section view of the assembly shown of FIG. 18.

The electrical interlock principle described above is well known in the art. An implementation of the electrical interlock is depicted in FIGS. 18 and 19. FIGS. 18 and 19 depict an exemplary safety switch which utilises the locking mechanism described in relation to FIGS. 1 to 17 above in conjunction with a contact block 100. Elements of the locking mechanism described in relation to FIGS. 1 to 17 and which also appear in FIGS. 18 and 19 are therefore given the same reference numerals.

In FIGS. 18 and 19, it can be seen that an end of the solenoid plunger 11 is in contact with the end of a contact plunger 110. The contact plunger 110 is moveable in the contact block 100, and along the same axis of movement as the solenoid plunger 11. The contact block plunger 110 is provided with a plurality of moveable bridging contacts 120 which extend through the body of the contact block plunger 110. The bridging contacts 120 are biased by springs 130. The contact block plunger 110 is moveable to move the bridging contacts 120 into or out of electrical connection with fixed contacts 140 provided in the contact block 110. The fixed contacts 140 may be connected to a power supply or machinery (not shown).

When the contact block plunger 110 is moved to bring some or all of the bridging contacts 120 into electrical connection with the fixed contacts 140, the safety switch is able to conduct electricity. The arrangement of the fixed contacts 140 and moveable contacts 120 may be chosen and/or configured such that the safety switch may only conduct electricity when the locking pins 15 are locked in position by the locking arms 19, i.e. when the actuator (not shown) cannot be removed from the safety switch. For example, it can be seen from the Figures that the contact block plunger 110 is biased against an end of the solenoid plunger 11 by a spring 150. When the solenoid plunger 11 is moved by energising of the solenoid (not shown, but described above) to unlock the locking mechanism, the contact block plunger 110 is moved to bring some of the bridging contacts 120 out of electrical connection with the fixed contacts, thus preventing the safety switch from conducting electricity.

Although the locking and electrical interlock mechanisms described in relation to FIGS. 1 to 19 work well, existing safety switches which use such mechanisms have can be improved upon. It can be seen from FIGS. 18 and 19 that elements forming the physical and electrical interlocks are commonly arranged in a linear fashion. This means that a safety switch which incorporates these mechanisms needs to be elongate to accommodate these mechanisms. Furthermore, due to the large number of co-operating elements forming the physical and electrical interlock mechanisms, the tolerances in the design and fabrication of co-operating elements needs to be small. It is difficult to consistently meet these small tolerances. If the tolerances are not met, the mechanisms may not work well, or may not work at all. For instance, referring to FIG. 19, if the end of the solenoid plunger 11 is, for example, 0.5 mm too far away from the end of the contact block plunger 110, there may be an unacceptable delay in the making or breaking of contacts in the contact block 100. It is possible that the gap between the end of the contact block plunger 110 and solenoid plunger 11 may prevent the moveable contacts from being moved into or out of electrical connections with the fixed contacts 140.

Figure 20:
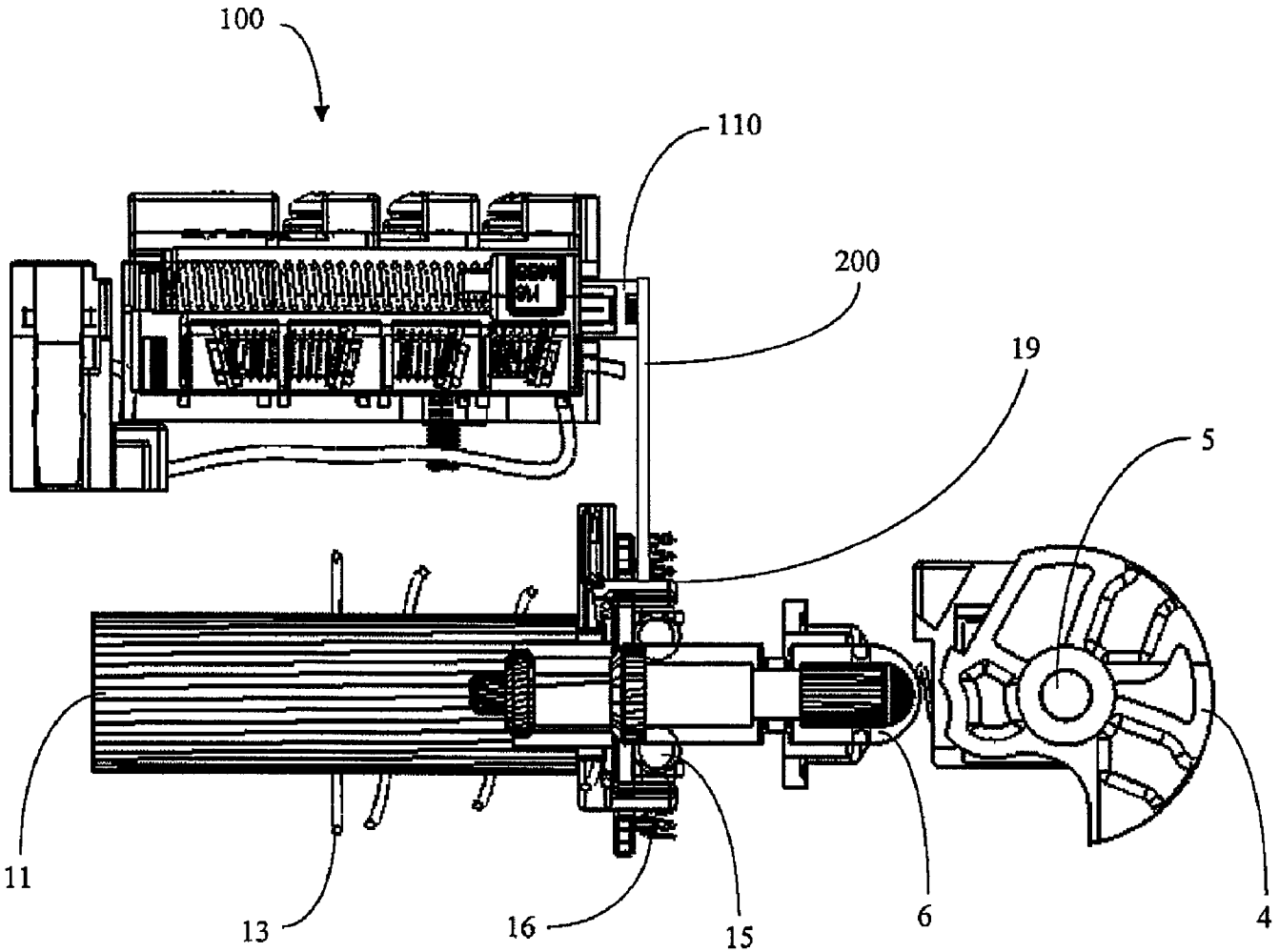
FIG. 20 is a cross-section view of another safety switch and locking mechanism according to the present invention.

The present invention provides a solution to the problems of the prior art. FIG. 20 shows a safety switch mechanism according to an embodiment of the present invention. The safety switch mechanism has the features of the lockable switch mechanism described in FIGS. 1-17, and also the electrical interlock features described with reference to FIGS. 18 and 19, and therefore like features are given the same reference numerals. In contrast to the mechanisms described in relation to FIGS. 18 and 19, however, the solenoid plunger 11 is no longer arranged to be in contact with an end of the contact block plunger 110. Instead, a linking member 200 physically connects the locking arm 19 to the contact block plunger 110. This means that movement of the locking arm 19 directly effects movement of the contact block plunger 110 and the contacts carried by the contact block plunger 110. The number of tolerances that have to be considered for features which co-operate is therefore reduced, since there is no relative movement between the locking arm 19 and the contact block plunger 110. This may make the mechanism of FIG. 20 easier to reliably construct. Furthermore, by attaching the contact block plunger 110 to the locking arm 19 via a linking member 200, the elements of the safety switch mechanism no longer have to be disposed a linear manner. It can be seen, for example, that the contact block 100 can now be placed alongside the locking mechanism, rather than in-line with it. This means that the shape of the safety switch which incorporates a mechanism according to an embodiment of the present invention does not have to be as elongate as those of the prior art. An additional advantage in the flexibility of the positioning of the contact block 100 is that more room may be available in existing or new safety switch housing for movement of the solenoid plunger 11. This means that a larger solenoid (not shown) could be used to move the solenoid plunger with greater speed and/or force, thereby improving the locking mechanism.

The linking member 200 can be formed from any suitable material, for example plastics or metals. The linking member 200 could be integrally formed with the contact block plunger 110, and then attached to the locking arm 19. Alternatively, the linking member 200 could be integrally formed with the locking arm 19, and then attached to the contact block plunger 110. Alternatively, the linking member could be attached to an independent element which is attached to both the locking arm 19 and the contact block plunger 110. The linking member may be a strip or rod of material, or maybe a more complex structure. In FIG. 20, it can be seen that the movement of the contact block plunger 110 is parallel to the movement of the solenoid plunger 11. Understandably, contact block plunger 110 need not be oriented in parallel association with solenoid plunger 11. The linking member could comprise or co-operate with a pivot or the like, such that axial movement of the solenoid plunger 11 causes movement of the contact block plunger in a direction other than parallel to the solenoid plunger 11. For example, the contact block plunger 110 may be made to move perpendicularly with respect to the movement of the solenoid plunger 11.

The spring 150 (or other biasing member) of the contact block 100 can be arranged to bias the contact block plunger 110 in such a way as to cause the bridging contacts 120 to be biased away from electrical connection (e.g. contact) with the fixed contacts 140. In normal use, the compression spring 13 dominates the spring 150, such that when an actuator is brought into engagement with the cam, the cam rotates and the switch plunger, locking arm 19, linking member 200 and contact block plunger 110 all moved to the right (in the orientation shown in FIG. 20). The bridging contacts 120 are brought into contact with the fixed contacts 140 and the safety switch is able to conduct electricity. However, if the linking member 200 breaks, or becomes detached from one or both of the contact block plunger 110 and locking arm 19, the spring 150 is no longer in any sort of contact or competition with the compression spring 13. The spring 150 is thus now able to move the contact block plunger 110, and push apart the bridging contacts 120 and the fixed contacts 140, thereby preventing the safety switch from conducting electricity. That is, if the linking member breaks, deforms, or becomes detached from one or both of the locking arm 19 and the contact block plunger 110 the switch fails to a safe (non-conducting) state.

Preferably, the spring 150 is only able to push apart the bridging contacts 120 and the fixed contacts 140 when the linking member breaks, deforms, or becomes detached from one or both of the locking arm 19 and the contact block plunger 110.

The linking member need not be attached to the locking arm, but could be attached to a structure which supports the locking arm, e.g. a locking fork (described above). In generic terms, the linking member is attached to the second locking member.

The contact block plunger 110 and/or the contact block 100 could be provided with guides and/or channels to guide the movement of the contact block plunger.

In the above embodiments, the locking arm has been described as being moved coaxially with respect to the switch plunger. Other orientations, such as crossing, perpendicular, or non-coaxial, are envisioned. The second locking member may move in any suitable direction to effect the locking in position of the switch plunger. For example, the second locking member may move in a direction perpendicular to the axial movement of the switch plunger.

In the above embodiments, the second locking member had been described as a locking arm. It will be appreciated that other elements may also serve as the second locking member or a part of the second locking member, for example wedges, or curved segments or the like. Similarly, the first locking members have thus far been described as pins. It will be appreciated that structures other than cylindrically shaped pins may serve as the first locking members. For example, the first locking members may be elliptical in cross section, or triangular. The first locking members may be wedges, or curved segments or the like.

It will be appreciated that the above embodiments have been given by way of example only. Various modifications may be made to these and indeed other embodiments without departing from the invention as defined by the claims that follow.

The invention claimed is:

1. A safety switch mechanism comprising:

a lockable switch mechanism comprising: a switch plunger which is mounted in a housing and is displaceable relative to the housing along a predetermined axis between a first unlocked position and a second position, a locking mechanism for locking the switch plunger in the second position, and a switch mechanism which is actuated by movements of the switch plunger between the first and second positions, wherein the locking mechanism comprises at least one first locking member which is biased against a surface of the switch plunger and at least one second locking member which is displaceable between locked and released positions, the surface of the switch plunger against which the first locking member is biased defining a profile arranged such that movement of the switch plunger from the second to the first position causes the profile to displace the first locking member, and the second locking member when in the locked position preventing displacement of the first locking member by the profile to thereby prevent movement of the switch plunger from the second to the first position; and a contact block comprising: a set of fixed contacts, and a contact block plunger provided with at least one bridging contact, the contact block plunger being moveable in the contact block to move the bridging contact into and out of electrical connection with the fixed contacts, and wherein the second locking member is attached to the contact block plunger via a linking member such that the second locking member, the linking member, and the switch plunger move in linear directions that are parallel with the predetermined axis.

2. A mechanism according to claim 1, wherein the contact block is provided with a biasing means which biases the contact block plunger such that the bridging contact is biased away from the fixed contacts.

3. A mechanism as claimed in claim 2, wherein the biasing means is only able to push apart the bridging contact and the fixed contacts when the linking member breaks, deforms, or becomes detached from one or both of the second locking member and the contact block plunger.

4. A mechanism according to claim 1, wherein at least one of the first locking member and second locking member comprises a locking pin extending transversely relative to the axis of displacement of the switch plunger, the locking pin being spring biased towards the switch plunger in a direction perpendicular to the axis.

5. A mechanism according to claim 4, wherein the locking pin is further defined as a first locking pin and the mechanism further comprises a second locking pin that is located on a side of the switch plunger that is generally opposite the first locking pin.

6. A mechanism according to claim 5, wherein the first and second locking pins are mounted in a housing assembly defining an aperture through which the switch plunger extends, the locking pins being spring-biased towards each other from opposite sides of the aperture by springs supported in the housing assembly.

7. A mechanism according to claim 6, wherein the housing assembly comprises a frame which receives the locking pins and springs and a cover plate which retains the locking pins and springs within the assembly.

8. A mechanism according to claim 1, wherein the profile is defined by an annular shoulder extending around the switch plunger.

9. A mechanism according to claim 1, wherein at least one of the first and second locking members further comprises at least one locking arm which is displaceable in a direction parallel to the switch plunger axis and, when in the locked position, extends on a side of the respective locking member remote from the switch plunger to prevent displacement of the respective locking member in a direction away from the switch plunger axis.

10. A mechanism according to claim 9, wherein the at least one locking arm defines a tapered surface that contacts a respective locking member when in the locked position, the tapered surface being arranged to facilitate release of the locking arm when the locking arm is displaced to the released position.

11. A mechanism according to claim 1 wherein each locking member includes two locking arms that are provided to lock respective locking pins against displacement relative to the switch plunger.

12. A mechanism according to claim 11, wherein the locking arms extend from one end of a solenoid plunger which is arranged at one end of the switch plunger and is displaceable along the switch plunger axis by a solenoid winding within a solenoid housing.

13. A mechanism according to claim 12, further comprising a compression spring that is one of, arranged between, to bias apart, the switch plunger and the solenoid plunger, or that is arranged between the solenoid plunger and the solenoid housing to bias the solenoid plunger toward the switch plunger.

14. A mechanism according to claim 1, wherein the switch plunger is biased against a cam that is rotatable from a datum position by insertion of an actuator into the mechanism and which engages the actuator to prevent removal of the actuator unless the cam is rotated to the datum position, the locking mechanism being arranged to prevent removal of the actuator if the switch plunger has been displaced by the cam to the second position and the second locking member has been displaced to the locked position.

15. A mechanism according to claim 1, wherein the contact block is positioned alongside the lockable switch mechanism.

16. A mechanism according to claim 1, wherein the contact block plunger is arranged to move in a generally parallel direction with respect to movement of the switch plunger.

17. A mechanism according to claim 1, wherein one of the contact block plunger or contact block is provided with one or guides or channels for guiding movement of the contact block plunger.

18. A safety switch mechanism comprising:

a switch plunger that is movable along an axis between a first position and a second position to actuate a switch mechanism having one or more contacts;

a contour formed along a surface of the switch plunger;

a pin that is biased against the surface of the switch plunger and positioned to cross the contour when the switch plunger moves between the first and second positions;

a locking member that is movable between an engaged position and a disengaged position;

a projection extending from the locking member and cooperating with the pin to maintain interference between the pin and the contour to prevent translation of the switch plunger independent of translation of an actuator; and a link extending in a radial direction from the projection of the locking member such that the axis of movement of the switch plunger is one of offset or oriented in a crossing direction relative to an axis of movement of a contact plunger.

19. The safety switch mechanism of claim 18 further comprising another pin oriented such that the pin and the another pin generally flank the switch plunger.

20. The safety switch mechanism of claim 19 further comprising another projection that extends from the locking member and selectively interferes with the another pin.

* * * * *